US011654684B2

(12) United States Patent
Arakane

(10) Patent No.: US 11,654,684 B2
(45) Date of Patent: May 23, 2023

(54) LIQUID EJECTING APPARATUS, CONTROLLING METHOD FOR LIQUID EJECTING APPARATUS AND MEDIUM STORING CONTROLLING PROGRAM FOR LIQUID EJECTING APPARATUS

(71) Applicant: Brother Kogyo Kabushiki Kaisha, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 25 days.

(21) Appl. No.: 17/401,747

(22) Filed: Aug. 13, 2021

(65) Prior Publication Data

US 2022/0063275 A1 Mar. 3, 2022

(30) Foreign Application Priority Data

Aug. 31, 2020 (JP) ..... JP2020-145601

(51) Int. Cl.
*B41J 2/165* (2006.01)

(52) U.S. Cl.
CPC ..... *B41J 2/1652* (2013.01)

(58) Field of Classification Search
CPC ..... B41J 2/1652; B41J 2/16526; B41J 2002/16529
See application file for complete search history.

(56) References Cited

U.S. PATENT DOCUMENTS

2018/0029369 A1* 2/2018 Arakane ..... B41J 2/16505

FOREIGN PATENT DOCUMENTS

| | | | |
|---|---|---|---|
| JP | H11-157101 A | | 6/1999 |
| JP | 2007083450 A | * | 4/2007 |
| JP | 2016-150486 A | | 8/2016 |

* cited by examiner

*Primary Examiner* — Sharon Polk
(74) *Attorney, Agent, or Firm* — Banner & Witcoff, Ltd.

(57) ABSTRACT

A liquid ejecting apparatus includes: a head having nozzles; a conveyor configured to convey a recording medium; and a controller. The controller executes: a recording processing of conveying the recording medium by the conveyor and ejecting liquid from the nozzles with respect to the recording medium based on image data; a flushing processing of discharging the liquid from the nozzles with respect to a flushing area, based on flushing data different from the image data; and a first determining processing of determining, based on the image data, whether a time interval after completion of a first recording processing and until start of a second recording processing exceeds a threshold value.

10 Claims, 11 Drawing Sheets

LIQUID EJECTING APPARATUS, CONTROLLING METHOD FOR LIQUID EJECTING APPARATUS AND MEDIUM STORING CONTROLLING PROGRAM FOR LIQUID EJECTING APPARATUS

CROSS REFERENCE TO RELATED APPLICATIONS

The present application claims priority from Japanese Patent Application No. 2020-145601, filed on Aug. 31, 2020, the disclosure of which is incorporated herein by reference in its entirety.

BACKGROUND

The present disclosure relates to a liquid ejecting apparatus provided with a head having a plurality of nozzles, and a controller, and configured to execute a recording processing and a flushing processing, and a controlling method for controlling the liquid ejecting apparatus and a medium storing a controlling program for the liquid ejecting apparatus.

DESCRIPTION OF THE RELATED ART

A liquid ejecting apparatus which is configured to be capable of performing a flushing processing in order to suppress the increase in viscosity of a liquid in the vicinity of a nozzle is known.

SUMMARY

Such a configuration is considered wherein the flushing processing is executed, for example, after completion of the recording processing for a preceding recording medium and before start of the recording processing for a succeeding recording medium. However, in a case that a time interval after the completion of the recording processing for the preceding recording medium and until the start of the recording processing for the succeeding recording medium is short (for example, in a case that a conveying interval between the recording media is short), there is a low possibility that any increase in the viscosity of the liquid might occur in the vicinity of the nozzle. If, nevertheless, the flushing processing is executed at the above-described timing, the liquid is consumed uselessly or unnecessarily and the recording speed is lowered as well.

An object of the present disclosure is to provide a liquid ejecting apparatus capable of suppressing any useless consumption of the liquid and any lowering in the recording speed due to the flushing processing, a controlling method for the liquid ejecting apparatus and a medium storing a controlling program for the liquid ejecting apparatus.

According to a first aspect of the present disclosure, there is provided a liquid ejecting apparatus including:

a head having a plurality of nozzles;

a conveyor configured to convey a recording medium; and a controller, wherein the controller is configured to execute:

a recording processing of causing the conveyor to convey the recording medium and causing the head to eject liquid from the nozzles with respect to the recording medium based on image data; and a flushing processing of discharging the liquid from the nozzles with respect to a flushing area, based on flushing data different from the image data, wherein the controller is further configured to execute a first determining processing of determining, based on the image data, whether a time interval after completion of a first recording processing and until start of a second recording processing exceeds a threshold value, the first recording processing being the recording processing with respect to a first area of the recording medium, the second recording processing being the recording processing with respect to a second area of the recording medium and being executed after the first recording processing, and wherein in a case that the controller determines that the time interval exceeds the threshold value in the first determining processing, the controller is configured to execute the flushing processing after the completion of the first recording processing and before the start of the second recording processing.

According to a second aspect of the present disclosure, there is provided a controlling method for controlling a liquid ejecting apparatus including a head having a plurality of nozzles, and a conveyor configured to convey a recording medium, the controlling method including:

a recording processing of causing the conveyor to convey the recording medium and causing the head to eject liquid from the nozzles with respect to the recording medium based on image data; and a flushing processing of discharging the liquid from the nozzles with respect to a flushing area, based on flushing data different from the image data, wherein the controlling method further comprises a first determining processing of determining, based on the image data, whether a time interval after completion of a first recording processing and until start of a second recording processing exceeds a threshold value, the first recording processing being the recording processing with respect to a first area of the recording medium, the second recording processing being the recording processing with respect to a second area of the recording medium and being executed after the first recording processing, and wherein in a case that the time interval is determined to exceed the threshold value in the first determining processing, the flushing processing is executed after the completion of the first recording processing and before the start of the second recording processing.

According to a third aspect of the present disclosure, there is provided a non-transitory medium storing a program for controlling a liquid ejecting apparatus including a head having a plurality of nozzles, a conveyor configured to convey a recording medium, and a controller, the program, when executed by the controller, causing the liquid ejecting apparatus to execute:

a recording processing of causing the conveyor to convey the recording medium and causing the head to eject liquid from the nozzles with respect to the recording medium based on image data; and a flushing processing of discharging the liquid from the nozzles with respect to a flushing area, based on flushing data different from the image data, wherein the program causes the liquid ejecting apparatus to further execute a first determining processing of determining, based on the image data, whether a time interval after completion of a first recording processing and until start of a second recording processing exceeds a threshold value, the first recording processing being the recording processing with respect to a first area of the recording medium, the second recording processing being the recording processing with respect to a second area of the recording medium and being executed after the first recording processing, and wherein in a case that the time interval is determined to exceed the threshold value by the first determining processing, the program causes the liquid ejecting apparatus to execute the flushing processing after the completion of the first recording processing and before the start of the second recording processing.

According to the present disclosure, in a case that the time interval is determined to exceed the threshold value, the flushing processing is executed after the completion of the first recording processing and before the start of the second recording processing. By executing the flushing processing at an appropriate timing in this manner (namely, at a timing required for suppressing the increase in the viscosity of the liquid in the vicinity of the nozzle), it is possible to suppress any useless consumption of the liquid and any lowering in the recording speed due to the flushing processing.

DETAILED DESCRIPTION

First Embodiment

First, the overall configuration of a printer 100 according to a first embodiment of the present disclosure and the configuration of respective parts of the printer 100 will be explained, with reference to FIGS. 1 to 3.

Figure 1:
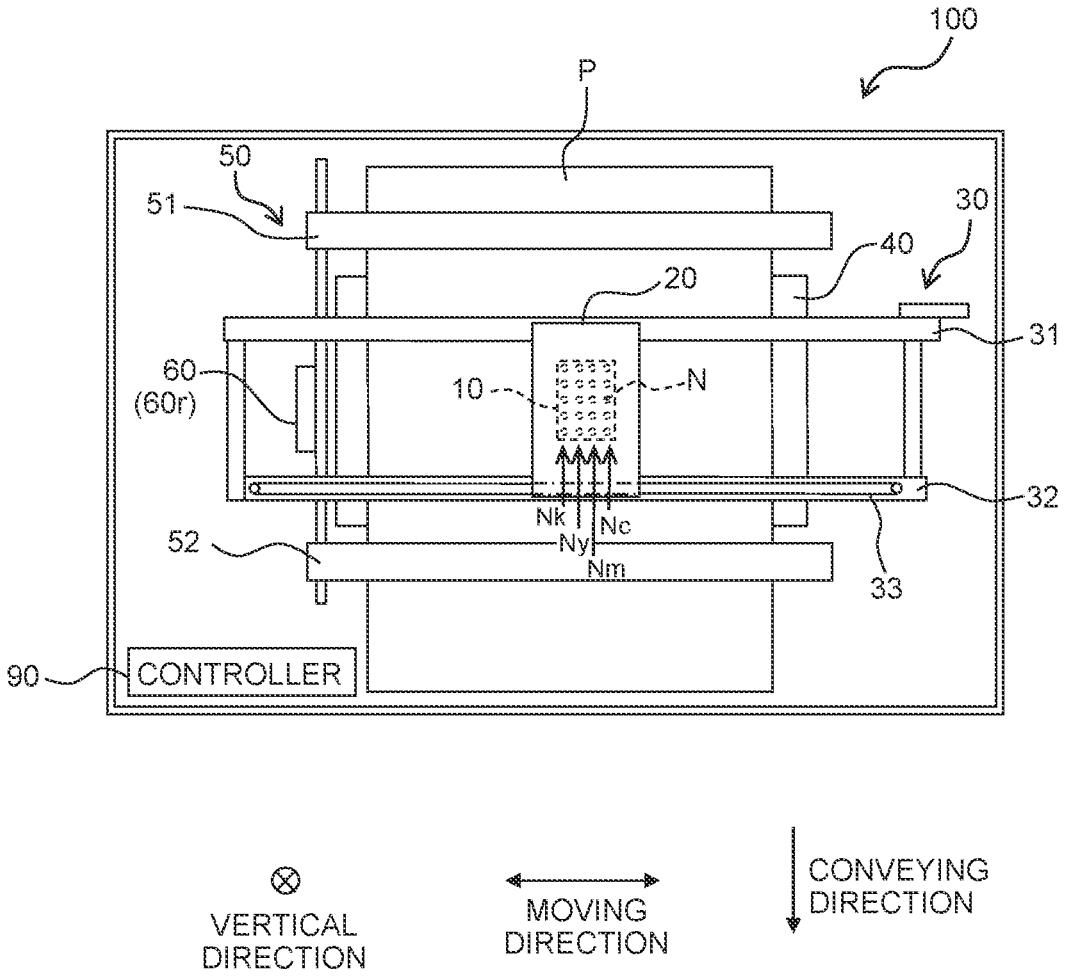
FIG. 1 is a plan view schematically depicting the overall configuration of a printer according to a first embodiment of the present disclosure.

As depicted in FIG. 1, the printer 1 is provided with: a head 10 having a plurality of nozzles N formed in a lower surface thereof; a carriage 20 holding the head 10; a moving mechanism 30 moving the carriage 20 and the head 10 in a moving direction (a direction orthogonal to the vertical direction); a platen 40 supporting a paper sheet (paper) P (recording medium) from therebelow; a conveyor 50 conveying the paper sheet P in a conveying direction (a direction orthogonal to the moving direction and the vertical direction); a flushing receiving member 60 arranged on one side in the moving direction with respect to the platen 40; and a controller 90.

The plurality of nozzles N construct four nozzle rows (nozzle arrays) Nc, Nm, Ny, and Nk arranged side by side in the moving direction. Each of the nozzle rows Nc, Nm, Ny and Nk is constructed of nozzles N, among the plurality of nozzles N, arranged side by side in the conveying direction. The nozzles N constructing the nozzle row Nc eject a cyan ink, the nozzles N constructing the nozzle row Nm eject a magenta ink; the nozzles N constructing the nozzle row Ny eject a yellow ink, and the nozzles N constructing the nozzle row Nk eject a black ink.

The moving mechanism 30 includes a pair of guides 31 and 32 supporting the carriage 20, and a belt 33 connected to the carriage 20. The pair of guides 31 and 32 and the belt 33 extend in the moving direction. In a case that a carriage motor 30*m* (see FIG. 3) is driven by control of the controller 90, the belt 33 runs, thereby causing the carriage 20 and the head 10 to move in the moving direction along the pair of guides 31 and 32.

The platen 40 is arranged at a location below the carriage 20 and the head 10. The paper sheet P is supported by an upper surface of the platen 40.

The conveyor 50 has two roller pairs 51 and 52. In the conveying direction, the head 10, the carriage 20 and the platen 40 are arranged between the roller pair 51 and the roller pair 52. In the case that a conveying motor 50*m* (see FIG. 3) is driven by the control of the controller 90, the roller pairs 51 and 52 rotate in a state that the paper sheet P is pinched therebetween, thereby conveying the paper sheet P in the conveying direction. In such a manner, the conveyor 50 conveys the paper sheet P relative to the head 10.

The flushing receiving member 60 is arranged between the pair of guides 31 and 32 in the conveying direction, and has a flushing area 60*r* in a surface thereof. The flushing area 60*r* is positioned at the outside of a conveying area of the paper sheet P by the conveyor 50, and is adjacent to the conveying area in the moving direction. A flushing processing, which will be described later on, is performed toward the flushing area 60*r*.

Figure 2:
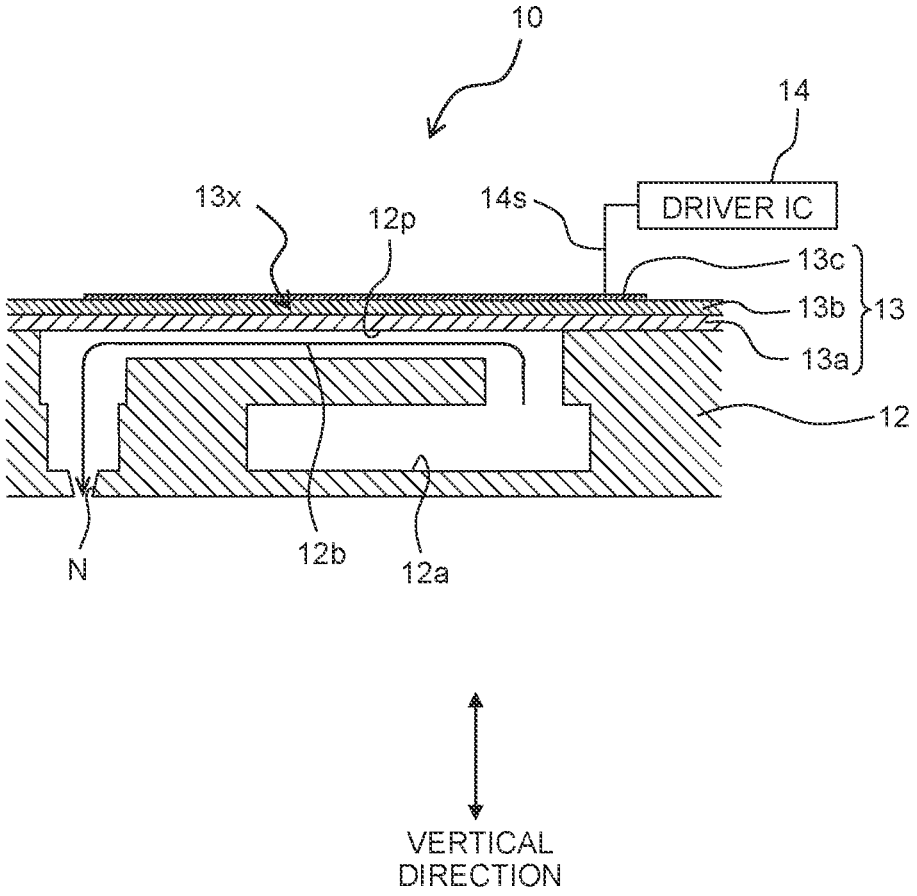
FIG. 2 is a cross-sectional view of a head depicted in FIG. 1.

As depicted in FIG. 2, the head 10 includes a channel unit 12 and an actuator unit 13.

The plurality of nozzles N (see FIG. 1) are formed in a lower surface of the channel unit 12. A common channel 12*a* communicating with an ink tank (not depicted in the drawings) and a plurality of individual channels 12*b* each of which communicates with one of the plurality of nozzles N are formed in the inside of the channel unit 12. Each of the plurality of individual channels 12*b* is a channel from an outlet of the common channel 12*a* and reaching one of the nozzles N via a pressure chamber 12*p*. A plurality of pieces of the pressure chamber 12*p* are opened in an upper surface of the channel unit 12.

The actuator unit 13 includes a metallic vibration plate 13*a* arranged on the upper surface of the actuator unit 12 so as to cover the plurality of pressure chambers 12*p*, a piezoelectric layer 13*b* arranged on an upper surface of the vibration plate 13*a*, and a plurality of individual electrodes 13*c* each of which is arranged on an upper surface of the piezoelectric layer 13*b* so as to face one of the plurality of pressure chambers 12*p*.

The vibration plate 13*a* and the plurality of individual electrodes 13*c* are electrically connected to a driver IC 14. The driver IC 14 maintains the potential of the vibration plate 13 at the ground potential, whereas the driver IC 14 changes the potential of each of the plurality of individual electrodes 13*c*. Specifically, the driver IC 14 generates a driving signal based on a control signal (a waveform signal FIRE and a selection signal SIN) from the controller 90, and supplies the driving signal to each of the plurality of individual electrodes 13*c* via a signal line 14*s*. With this, the potential of the individual electrode 13*c* is changed between a predetermined driving potential (VDD) and the ground potential (0V). In this situation, parts (actuator 13*x*) of the vibration plate 13*a* and the piezoelectric layer 13*b*, respectively, which are sandwiched between each of the plurality of individual electrodes 13*c* and one of the pressure chambers 12*p* corresponding thereto are deformed, thereby changing the volume of the pressure chamber 12*p*. As a result, pressure is applied to the ink inside the pressure chamber 12*p*, ejecting the ink from the nozzle N. The actuator 13*x* is provided as a plurality of actuators 13X each of which is provided on one of the plurality of individual electrodes 13*c* (namely, on one of the nozzles N); each of the plurality of actuators 13*x* is deformable independently in accordance with the potential supplied to each of the plurality of individual electrodes 13*c*.

Figure 3:
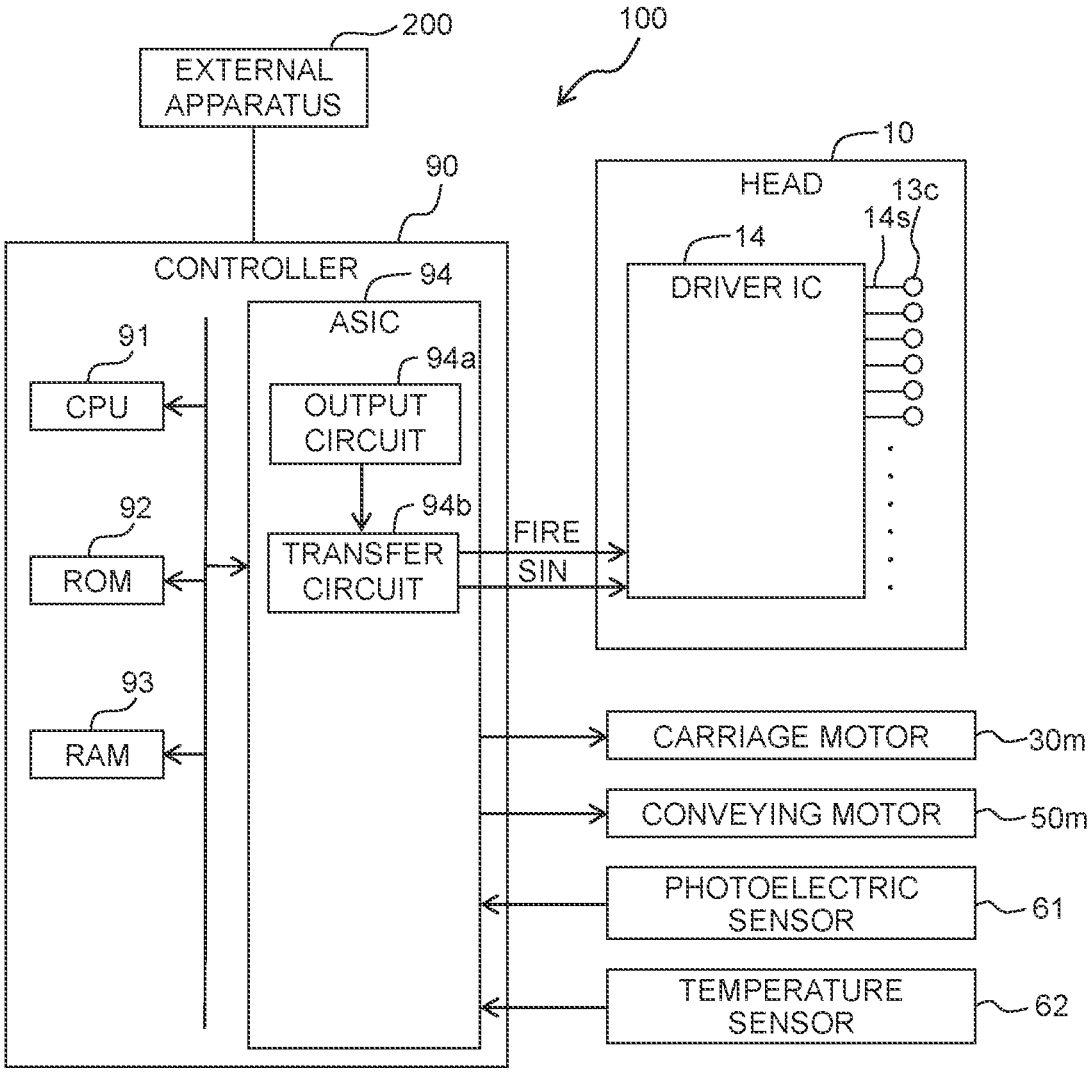
FIG. 3 is a block diagram depicting the electrical configuration of the printer of FIG. 1.

As depicted in FIG. 3, the controller 90 includes a CPU (Central Processing Unit) 91, a ROM (Read Only Memory) 92, a RAM (Random Access Memory) 93 and an ASIC (Application Specific Integrated Circuit) 94. Among the above-described elements, the CPU 91 and the ASIC 94 correspond to a "controller" of the present disclosure, and the RAM 93 corresponds to a "memory" of the present disclosure.

A program and data for allowing the CPU 91 and/or the ASIC 94 to perform a variety of kinds of control is stored in the ROM 92. The RAM 93 temporarily stores data (image data, etc.) which is used by the CPU 91 and/or the ASIC 94 in a case of executing a program. The controller 90 is connected to an external apparatus (personal computer, etc.) 200 so that the controller 90 is capable of communicating with the external apparatus 200, and executes a recording processing, etc., with the CPU 91 and/or the ASIC 94 based on data inputted from the external apparatus 200 or from an input pail of the printer 100 (a switch, a button, etc., provided on an outer surface of a casing of the printer 100).

In the recording processing, the ASIC 94 drives the driver IC 14, the carriage motor 30*m* and the conveying motor 50*m*, by following an instruction from the CPU 91 and based on a recording instruction or command received from the external apparatus 200, etc. With this, a conveying operation of causing the conveyor 50 to convey the paper sheet P by a predetermined amount in the conveying direction, and a moving operation of ejecting the ink(s) from the nozzles N while moving the carriage 20 and the head 10 in the moving direction are alternately performed. As a result, dots of the ink(s) are formed on the paper sheet P, and an image is recorded on the paper sheet P.

As depicted in FIG. 3, the ASIC 94 includes an output circuit 94*a* and a transfer circuit 94*b*.

The output circuit 94*a* generates the waveform signal FIRE and the selection signal SIN, and outputs these signals FIRE and SIN to the transfer circuit 94*a* for every recording cycle. The recording cycle is a time required for the paper sheet P moves relative to the head 10 only by a unit distance corresponding to the resolution of an image to be formed on the paper sheet P, and one piece of the recording cycle T corresponds to one pixel (picture element).

The waveform signal FIRE is a serial signal in which four pieces of waveform data are arranged in series. The four pieces of the waveform data correspond to respective liquid amounts of the ink which are ejected from the nozzle N in one recording cycle which are "zero (no ejection)", "small", "medium" and "large", and have mutually different pulse numbers.

The selection signal SIN is a serial signal including selection data for selecting one waveform data among the four pieces of the waveform data as described above, and is generated for each of the actuators 13*x* and for each recording cycle based on the image data included in the recording instruction.

The transfer circuit 94*b* transfers the waveform signal FIRE and the selection signal SIN received from the output circuit 94*a* to the driver IC 14. The transfer circuit 94*b* has a LVDS (Low Voltage Differential Signaling) driver installed therein and corresponding to each of the signals FIRE and SIN, and transfers each of the signals FIRE and SIN to the driver IC 14, as a pulse-shaped differential signal.

The ASIC 94 controls the driver IC 14 in the recording processing, generates the driving signal based on the waveform signal FIRE and the selection signal SIN for each pixel, and supplies the driving signal to each of the plurality of individual electrodes 13*c* via the signal line 14*s*. With this, the ASIC 94 ejects, for each pixel, the ink of which droplet amount is selected from the four kinds of liquid droplet amounts (zero, small, medium and large) from each of the plurality of nozzles N, toward the paper sheet P.

The ASIC 94 is electrically connected also to a photoelectric sensor 61 and a temperature sensor 62, in addition to the driver IC 14, the carriage motor 30*m* and the conveying motor 50*m*.

The photoelectric sensor 61 has a light-emitting element and a light-receiving element, and outputs data indicating an amount of light received by the light-receiving element to the ASIC 91. There is a case that the light emitted from the light-emitting element is received by the light-receiving element and a case that the light emitted from the light-emitting element is not received by the light-receiving element, depending on the position of a jam detecting member (not depicted in the drawings). Specifically, in a case that any jam of the paper sheet P does not occur, the jam detecting member is at a position shielding or blocking the light emitted from the light-emitting element, and thus the light emitted from the light-emitting element is not received by the light-receiving element. On the other hand, in case that a jam of the paper sheet P occurs, the jam detecting member is brought into contact with the paper sheet P and is thereby moved from the above-described position to a position at which the jam detecting member does not shield or block the light emitted from the light-emitting element, and thus the light emitted from the light-emitting element is received by the light-receiving element.

The temperature sensor 62 detects the temperature of the conveying motor 50*m*, and outputs data indicating the temperature to the ASIC 91.

Next, an explanation will be given about a program executed by the CPU 91, with reference to FIGS. 4 to 6. The program is executed in parallel with the recording processing, after the controller 90 receives the recording instruction from the external apparatus 200, etc.

Figure 4A:
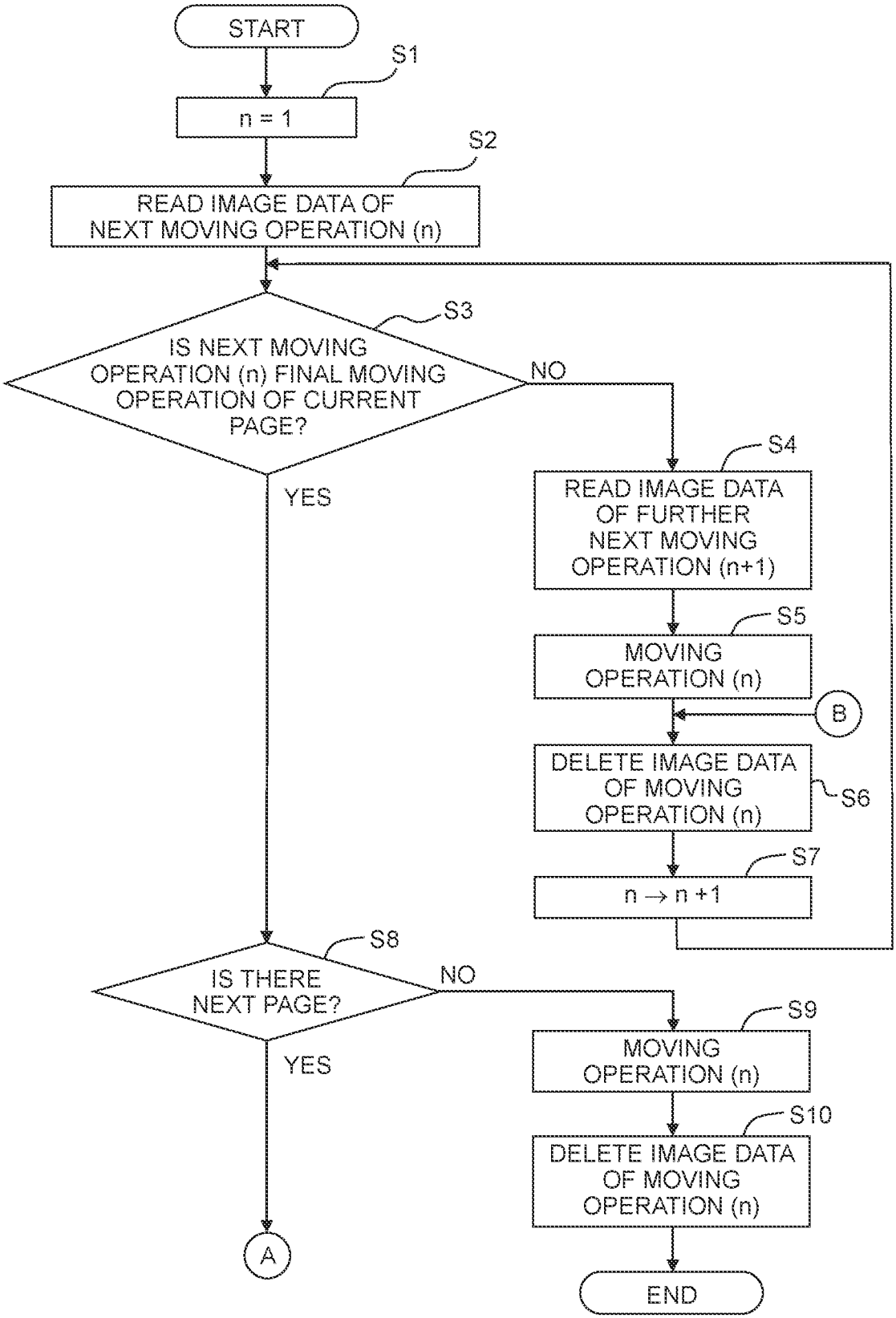
FIGS. 4A and 4B are a flow chart indicating a processing executed by a CPU of the printer of FIG. 1.

The CPU 91 firstly makes "n" to be "1" (step S1), as depicted in FIG. 4A. The "n" is a number given for each of the moving operation in a time-series order.

After step S1, the CPU 91 reads, into the RAM 93, image data which is among the image data included in the recording instruction and which is of a moving operation (n) to be executed next (step S2). The term "image data of the moving operation (n)" means data for ejecting the ink(s) from the plurality of nozzles N in the moving operation (n).

After step S2, the CPU 91 determines whether or not the moving operation (n) which is to be executed next is the final (last) moving operation of a current page (step S3). The term "current page" is a paper sheet P which is the object (target) of the moving operation (n).

Figure 6:
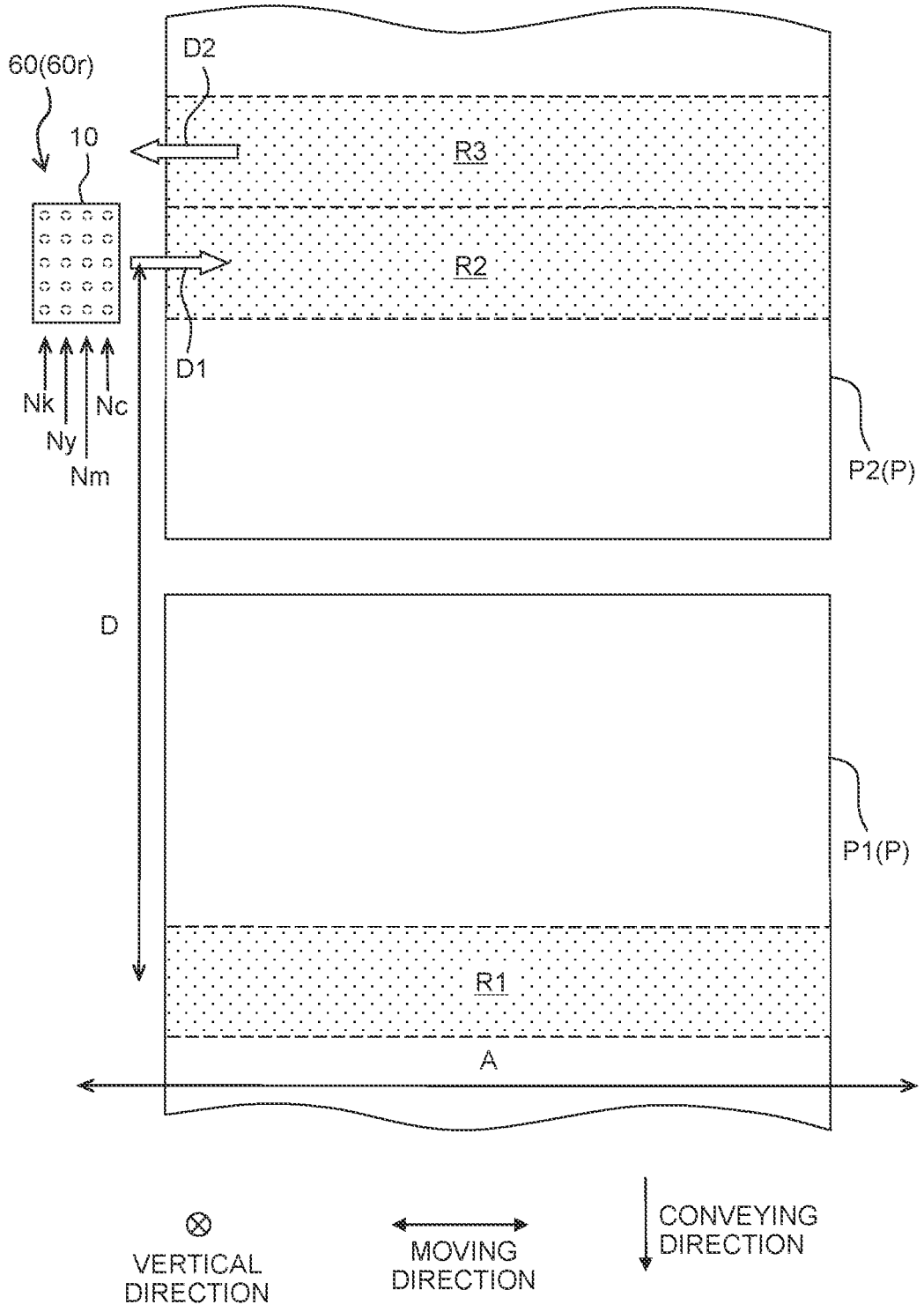
FIG. 6 is a schematic view depicting a situation in which a recording processing is sequentially performed with respect to a plurality of pieces of paper sheet in the first embodiment of the present disclosure.

In the recording processing, as depicted in FIG. 6, a plurality of paper sheets P and P2 are conveyed in a sequential manner, and one time or a plurality of times of the moving operation is/are executed for each of the paper sheets P1 and P2 (one page).

For example, in a case that the moving operation (n) to be executed next is a recording processing (first recording processing) with respect to an area R1 of the paper sheet P1 as depicted in FIG. 6, the CPU 91 determines that the moving operation (n) to be executed next is the final moving operation for the current page (paper sheet P1) (step S3: YES).

In a case that the moving operation (n) to be executed next is a recording processing (second recording processing) with respect to an area R2 of the paper sheet P2 as depicted in FIG. 6, the CPU 91 determines that the moving operation (n) to be executed next is not the final moving operation for the current page (paper sheet P2) (step S3: NO). This is because a recording processing (third moving operation) with respect to an area R3 of the paper sheet P2 is (to be) executed after the second moving operation.

Each of the areas R1 to R3 is an area, of the paper sheet P, which overlaps with head 10 while one time of the moving operation, and which is a rectangular area extending in the moving direction. The area R1 is an area of the preceding paper sheet P1, and the areas R2 and R3 are areas of the succeeding paper sheet P2. The areas R1 to R3 are arranged side by side in the conveying direction. The area R2 is positioned on the upstream side in the conveying direction with respect to the area R1. The area R3 is positioned on the upstream side in the conveying direction with respect to the area R2. The area R1 corresponding to a "first area" of the present disclosure, the area R2 corresponding to a "second area" of the present disclosure, and the area R3 corresponding to a "third area" of the present disclosure.

In a case that the CPU 91 determines that the moving operation (n) to be executed next is not the final moving operation for the current page (step S3: NO), the CPU 91 further reads, into the RAM 93, image data which is among the image data included in the recording instruction and which is of a moving operation (n+1) to be executed next (step S4).

For example, in a case that the moving operation (n) to be executed next is the recording processing (second recording processing) with respect to the area R2 of the paper sheet P2 as depicted in FIG. 6, then in step S4, the CPU 91 further reads, into the RAM 93, image data (third image data) which is among the image data included in the recording instruction and which is of a recording processing (third moving operation) with respect to the area R3 of the paper sheet P2, as the image data of the moving operation (n+1) to be executed next. In this situation, there is provided a state that the image data (second image data) of the second moving operation and the image data (third image data) of the third moving operation are stored in the RAM 93.

The image data may be either one of RGB (Red, Green, Blue) data corresponding to the color of the image, and CMYK (Cyan, Magenta, Yellow, Black) data corresponding to the color of the ink(s). For example, it is allowable that the external apparatus 200 transmits the RGB data to the controller 90, and that the CPU 91 reads the RGB data into the RAM 93. Alternatively, it is allowable that the external apparatus 200 converts the RGB data into the CMYK data and transmits the converted CMYK data to the controller 90, and that the controller 90 reads the CMYK data into the RAM 93.

After step S4, the CPU 91 executes the moving operation (n) (step S5).

The moving operation includes two cases which are a case of movement from one side (left side in FIG. 6) toward the other side (right side in FIG. 6) in the moving direction (forward moving operation), and a case of movement from the other side (right side in FIG. 6) toward the one side (left side in FIG. 6) in the moving direction (reverse moving operation). The flushing receiving member 60 is positioned on the one side in the moving direction (the left side in FIG. 6: direction D2) with respect to the conveying area, and at a start point of time of the "forward moving operation" and at an end point of time of the "reverse moving operation", the head 10 overlaps with the flushing area 60*r* in the vertical direction.

Whether to execute either one of the "forward moving operation" and the "reverse moving operation" may be determined as follows. As the first moving operation for a case that the moving operation is to be executed only one time with respect to the paper sheet P1 or P2 (one page), and for a case that the moving operation is to be executed a plurality of times with respect to the paper sheet P1 or P2 (one page), either one of the "forward moving operation" and the "reverse moving operation" is arbitrarily selected (for example, depending on the position of the head 10 before the start of the moving operation). A second moving operation and thereafter for the case that the moving operation is to be executed a plurality of times with respect to one piece of the paper sheet P1 or P2 (one page) is determined, as follows, so as to suppress any color difference (difference between an image indicated by the image data and an image recorded on the paper sheet P). Since the nozzle rows Nc, Nm, Ny and Nk are arranged asymmetrically with respect to the moving direction, the inks are landed on the paper sheet P in an order of "CMYK" in the direction D1 of the forward moving operation. On the other hand, in the direction D2 of the reverse moving operation, the inks are landed on the paper sheet P in an order of "KYMC". Due to such a difference in the overlapping order of the inks, any color difference might occur between the case of the forward moving operation and the case of the reverse moving operation. In order to suppress the color difference, the CPU 91 firstly makes addition of "weight values" corresponding to respective sets of pixel values (RGB values: gradation values from 0 to 255) of the respective pixels of partitioned areas each of which is obtained by partitioning each of the areas R1 to R3, corresponding to the moving operation, into a plurality of partitioned areas. In a case that the added weight values do not exceed a threshold value in any one of the partitioned areas, the CPU 91 determines to execute a moving operation in an opposite direction to that of a previously performed moving operation (for example, in a case that the previously performed moving operation is the "forward moving operation", the "reverse moving operation" is to be executed), whereas in a case that the previously performed moving operation is the "reverse moving operation", the "forward moving operation" is to be executed). On the other hand, in a case that the added weight values exceed a threshold value in any one of the partitioned areas, the CPU 91 determines to execute a moving operation in a same direction to that of a previously performed moving operation (for example, in a case that the previously performed moving operation is the "forward moving operation", the "forward moving operation" is to be executed), whereas in a case that the previously performed moving operation is the "reverse moving operation", the "reverse moving operation" is to be executed).

In a case of executing the moving operation in the same direction as that of the previously performed moving operation, an operation of moving the head 10 in a direction opposite to the above-described direction without ejecting the ink from the nozzles N is performed between the previously performed moving operation and the moving operation to be performed this time. On the other hand, in a case of executing the moving operation in the opposite direction to that of the previously performed moving operation, the operation of moving the head 10 in the moving direction is not performed between the previously performed moving operation and the moving operation to be performed this time.

After step S5, the CPU 91 deletes the image data of the moving operation (n) from the RAM 93 (step S6).

After step S6, the CPU 91 makes "n" to be "n+1" (step S7), and returns the processing to step S3.

In a case that the CPU 91 determines that the moving operation (n) which is to be performed next is the final moving operation of the current page (step S3: YES), the CPU 91 determines whether or not there is a next page (step S8).

For example, in a case that the moving operation (n) to be performed next is a recording processing (first recording processing) with respect to the area R1 of the paper sheet P1 as depicted in FIG. 6, the CPU 91 determines that there is the next page (paper sheet P2) (step S8: YES).

In a case that the moving operation (n) to be performed next is a recording processing (third recording processing) with respect to the area R3 of the paper sheet P2 as depicted in FIG. 6 and that there is no paper sheet P succeeding to the paper sheet P2, the CPU 91 determines that there is no the next page (step S8: NO).

In a case that the CPU 91 determines that there is no next page (step S8: NO), the CPU 91 executes the moving operation (n) (step S9). After step S9, the CPU 91 deletes the image data of the moving operation (n) from the RAM 93 (step S10), and ends the routine.

In a case that the CPU 91 determines that there is a next page (step S8: YES), the CPU 91 reads, into the RAM 93, image data which is among the image data included in the recording instruction and which is image data of a first moving operation (n+1) on the next page (step S11).

For example, in a case that the moving operation (n) to be performed next is a recording processing (first recording processing) with respect to the area R1 of the paper sheet P1 as depicted in FIG. 6, then in step S11, the CPU 91 reads, into the RAM 93, image data (second image data) which is among the image data included in the recording instruction and which is image data of a recording processing (second moving operation) with respect to the area R2 of the paper sheet P2, as the image data of the first moving operation (n+1) on the next page. Namely, before the recording processing (first moving operation) with respect to the area R1 of the paper sheet P1, there is provided a state that the image data (first image data) of the first moving operation and the image data (second image data) of the second moving operation are stored in the RAM 93. Note that the recording processing includes the first moving operation and the second moving operation. The image data includes the first image data and the second mage data.

After step S11, the CPU 91 executes a final moving operation (n) of the current page (step S12). For example, in a case that the moving operation (n) is the recording processing (first moving operation) with respect to the area R1, the CPU 91 starts, in step S12, the first moving operation in a state that the image data of the recording processing (first moving operation) with respect to the area R1 and the image data of the recording processing (second moving operation) with respect to the area R2 are stored in the RAM 93.

After step S12, the CPU 91 obtains a time interval T (step S13). The time interval T represents a time after completion of the final moving operation (n) on the current page and until start of the first moving operation (n+1) on the next page.

Here, an explanation will be given about the obtainment of the time interval T (step S13), with reference to FIGS. 5A and 5B.

In the following explanation, a case is assumed wherein the final moving operation (n) on the current page is the recording processing (first moving operation) with respect to the area R1 of the paper sheet P1 as depicted in FIG. 6, and the first moving operation (n+1) on the next page is the recording processing (second moving operation) with respect to the area R2 of the paper sheet P2 as depicted in FIG. 6. The recording processing (first moving operation) with respect to the area R1 corresponds to the "first recording processing" of the present disclosure, and the recording processing (second moving operation) with respect to the area R2 corresponds to the "second recording processing" of the present disclosure.

Figure 5A:
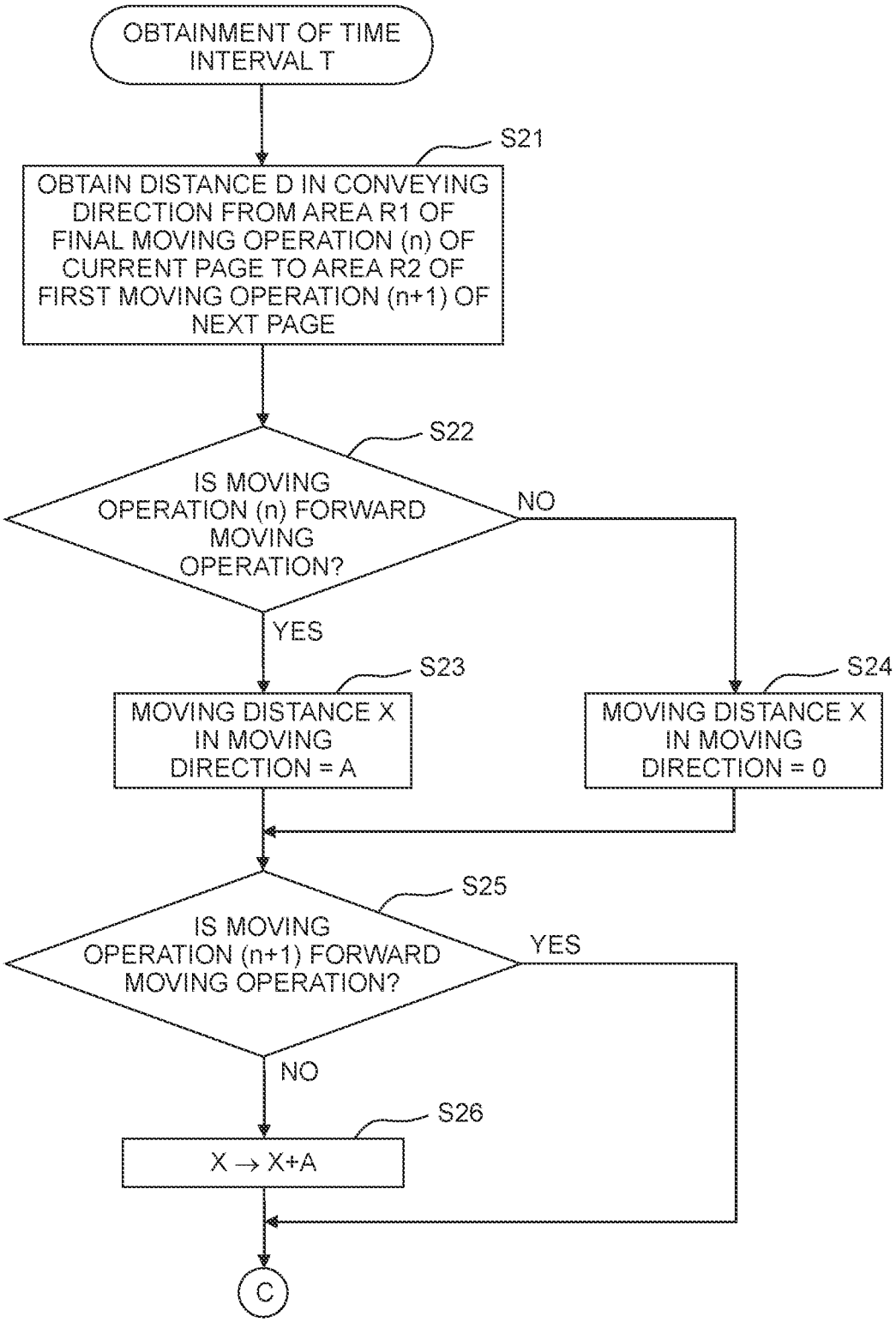
FIGS. 5A and 5B are a flow chart indicating a subroutine of obtaining a time interval T indicated in FIG. 4B.

As depicted in FIG. 5A, the CPU 91 firstly obtains a distance D (see FIG. 6) in the conveying direction from the area R1 to the area R2 (step S21). In step S21, the CPU 91 obtains positional information in the conveying direction of the areas R1 and R2, and obtains the distance D based on the positional information.

After step S21, the CPU 91 determines whether or not the moving direction is the "forward moving direction" (step S22).

In a case that the CPU 91 determines that the moving operation (n) is the "forward moving operation" (step S22: YES), the CPU 91 makes a moving distance X to be "A" ("A" is made to be a moving distance in the moving direction of the head 10 from the start point to the end point of one time of the moving operation) (step S23). In a case that the CPU 91 determines that the moving operation (n) is not the "forward moving operation" (that the moving operation (n) is the "reverse moving operation") (step S22: NO), the CPU 91 makes the moving distance X to be "0" (step S24).

The moving distance X is a moving distance in the moving direction of the head 10 after the completion of the moving operation (n) and until the start of the moving operation (n+1). In each of steps S23 and S24, the CPU 91 firstly sets a moving distance in the moving direction of the head 10 "from the end point of the moving operation (n) to the flushing area 60*r*" to be the moving distance X.

After step S23 or S24, the CPU 91 determines whether or not the moving operation (n+1) is the "forward moving operation" (step S25).

In a case that the CPU 91 determines that the moving operation (n+1) is not the "forward moving operation" (that the moving operation (n+1) is the "reverse moving operation") (step S25: NO), the CPU 91 makes the moving distance X to be "X+A" (step S26). Here, the moving distance in the moving direction of the head "from the flushing area 60*r* to the start point of the moving operation (n+1) is added to the distance set in step S23 or S24.

In a case that the CPU 91 determines that the moving operation (n+1) is the "forward moving operation" (step S25: YES), the CPU 91 skips the step S26, and proceeds the processing to step S27. This is because in a case that the moving operation (n+1) is the "forward moving operation", the start point of the moving operation (n+1) is located immediately above the flushing area 60*r*, and the moving distance in the moving direction of the head 10 from the flushing area 60*r* to the start point of the moving operation (n+1) is zero (0).

After step S26, or in a case that the CPU 91 determines that the moving operation (n+1) is the "forward moving operation" (step S25: YES), the CPU 91 determines whether or not the temperature of the conveying motor 50*m* is not less than 70° C., based on the data received from the temperature sensor 62 (see FIG. 3) (step S27). In the present embodiment, in a case that the temperature of the conveying motor 50*m* is not less than 70° C., the CPU 91 stops the conveyance of the paper sheet P only for a predetermined time Tw after the completion of the moving operation (n). Namely, step S27 is a processing of determining whether or not the conveyance of the paper sheet P is to be stopped for the predetermined time after the completion of the moving operation (n), and corresponds to a "third determining processing" of the present disclosure.

In the case that the CPU 91 determines that the temperature of the conveying motor 50*m* is not less than 70° C. (step S27: YES), the CPU 91 calculates the time interval T by a formula "Tw+D/Vp1+X/Vc" (step S28). Namely, in step S28, the CPU 91 obtains the time interval T based on the distance D in the conveying direction from the area R1 to the area R2. Here, "Tw" is the predetermined time, "D" is the distance obtained in step S21, "X" is the distance obtained in step S23, step S24, or step S26, "Vp1" is the conveying speed of the paper sheet P by the conveyor 50, and "Vc" is the moving speed of the head 10 by the moving mechanism 30.

In the case that the CPU 91 determines that the temperature of the conveying motor 50*m* is less than 70° C. (step S27: NO), the CPU 91 determines whether or not the temperature of the conveying motor 50*m* is not less than 60° C. (step S29). In the present embodiment, in a case that the temperature of the conveying motor 50*m* is in a range of not less than 60° C. and less than 70° C., the CPU 91 lowers the conveying speed from Vp1 to Vp2 after the completion of the moving operation (n) (Vp2<Vp1). Namely, step S29 is a processing of determining whether or not the conveying speed of the paper sheet P by the conveyor 50 is to be lowered from Vp1 to Vp2 after the completion of the moving operation (n), and corresponds to a "second determining processing" of the present disclosure.

In the case that the CPU 91 determines that the temperature of the conveying motor 50*m* is less than 60° C. (step S29: NO), the CPU 91 calculates the time interval T from a formula "D/Vp1+X/Vc" (step S30).

In the case that the CPU 91 determines that the temperature of the conveying motor 50*m* is not less than 60° C. (step S29: YES), the CPU 91 calculates the time interval T from a formula "D/Vp2+X/Vc" (step S31).

After step S28, S30 or S31, the CPU 91 ends the subroutine.

Returning to FIG. 4B, after step S13, the CPU 91 determines whether or not the time interval T exceeds a threshold value (step S14). Step S14 is a processing of determining, based on the first image data, whether or not the time interval after the completion of the recording processing with respect to the area R1 of the paper sheet P1 until the start of the recording processing with respect to the area R2 of the paper sheet P2 exceeds the threshold value, and corresponds to a "first determining processing" of the present disclosure.

In a case that the CPU 91 determines that the time interval T exceeds the threshold value (step S14: YES), the CPU 91 executes the flushing processing (step S15). The flushing processing is a processing of discharging, based on flushing data different from the image data, the ink(s) from the plurality of nozzles N with respect to the flushing area 60*r*. In step S15, the CPU 91 arranges the head 10 at a location immediately above the flushing area 60*r* (see FIG. 6), and drives the actuators 13*x* by the driver IC 14, and discharges the ink(s) from the nozzles N. The ink(s) is/are received by the flushing area 60*r*, and flow(s) to a waste ink tank (not depicted in the drawings).

In a case that the CPU 91 determines that the time interval T does not exceed the threshold value (step S14: NO), the CPU 91 determines whether or not the jam of the paper sheet P is detected (step S16). In step S16, in a case that data indicating a light amount of not less than a predetermined amount is received from the photoelectric sensor 61 (see FIG. 3) continuously for not less than a predetermined time, the CPU 91 determines that the jam of the paper sheet P is detected.

In a case that the CPU 91 determines that the jam of the paper sheet P is detected (step S16: YES), the CPU 91 executes the flushing processing (step S15). Namely, in a case that the CPU 91 determines that the time interval T does not exceed the threshold value and determines that the jam of the paper sheet P is detected, the CPU 91 executes the flushing processing after the completion of the moving operation (n) and before the start of the moving operation (n+1).

In a case that the CPU 91 determines that the jam of the paper sheet P is not detected (step S16: NO), or after step S15, the CPU 91 returns the processing to step S6.

For example, in a case that the flushing processing (step S15) is executed after the execution of the recording processing (first moving operation) with respect to the area R1 in step S12, and that the processing is returned to step S6, or in a case that the processing is returned to step S6 without executing the flushing processing (step S15), the image data (first image data) of the recording processing (first moving operation) with respect to the area R1 is deleted from the RAM 93 in step S6. After the image data of the recording processing with respect to the area R1 is deleted from the RAM 93, the processing is returned to step S3 via step S7; and in step S4, the image data (third image data) of the recording processing (third moving operation) with respect to the area R3 is read into the RAM 93. Then, in step S5, the recording processing (second moving operation) with respect to the area R2 is started in the state that the image data (second image data) of the recording processing (second moving operation) with respect to the area R2 and the image data (third image data) of the recording processing (third moving operation) with respect to the area R3 are stored in the RAM 93. Furthermore, after the recording processing (second moving operation) with respect to the area R2 is executed in step S5, the image data (second image data) of the recording processing (second moving operation) with respect to the area R2 is deleted from the RAM 93 in step S6. Note that the recording processing includes the third moving operation, and that the image data includes the third image data.

Figure 4B:
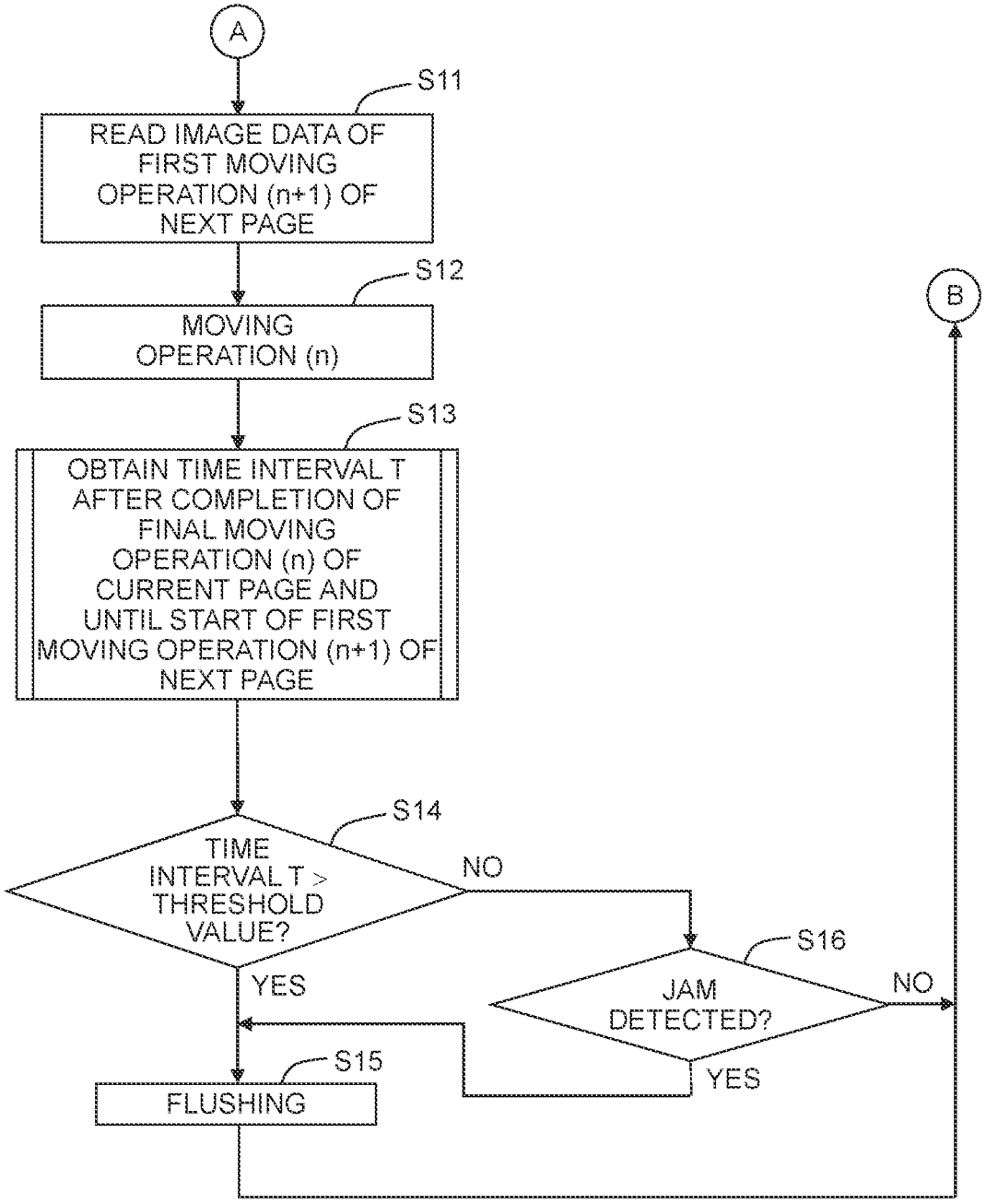

As described above, according to the present embodiment, in a case that the CPU 91 determines that the time interval T exceeds the threshold value (step S14: YES), the CPU 91 executes the flushing processing (step S15) after the completion of the first recording processing (recording processing with respect to the area R1: step S12) and before the start of the second recording processing (recording processing with respect to the area R2: step S5), as depicted in FIGS. 4A and 4B (the flow is in the following order: step S12 to step S14: YES to step S15 to step S7, and to step S5). By executing the flushing processing at such an appropriate timing (namely, a timing required for suppressing the increase in the viscosity of the ink in the vicinity of the nozzle N), it is possible to suppress any useless consumption of the ink and the lowering in the recording speed due to the flushing processing.

The printer 100 is provided with the moving mechanism 30 (see FIG. 1). In the recording processing, the CPU 91 performs the conveying operation of causing the conveyor 50 to convey the paper sheet P by the predetermined amount in the conveying direction, and the moving operation of ejecting the ink(s) from the nozzles N while moving the head 10 in the moving direction. In this configuration, each of the areas R1 and R2 is the area, in the paper sheet P, which corresponds to one time of the moving operation, and the area R2 is positioned on the upstream side in the conveying direction with respect to the area R1 (see FIG. 6). In this case, the present disclosure can be effectively realized in the head 10 of the serial system.

Before the CPU 91 executes the moving operation (n) in step S12, the CPU 91 provides the state that the image data of the moving operation (n) (for example, the first image data of the area R1) and the image data of the moving operation (n+1) (for example, the second image data of the area R2) are stored in the RAM 93, and the CPU 91 executes the moving operation (n) in this state, as depicted in FIGS. 4A and 4B. Afterwards, the CPU 91 deletes the image data of the moving operation (n) from the RAM 93, via the first determining processing (step S14). Further, regarding the next moving operation (n+1), the CPU 91 executes the similar processing. In such a manner, the CPU 91 executes the first determining processing (step S14) between the successively executed moving operations, whereas the CPU 91 executes the flushing processing (step S15) in a case that the time interval T exceeds the threshold value. With this, it is possible to obtain the effect of suppressing the increase in the viscosity of the ink in the vicinity of the nozzle N in a more ensured manner.

Figure 5B:
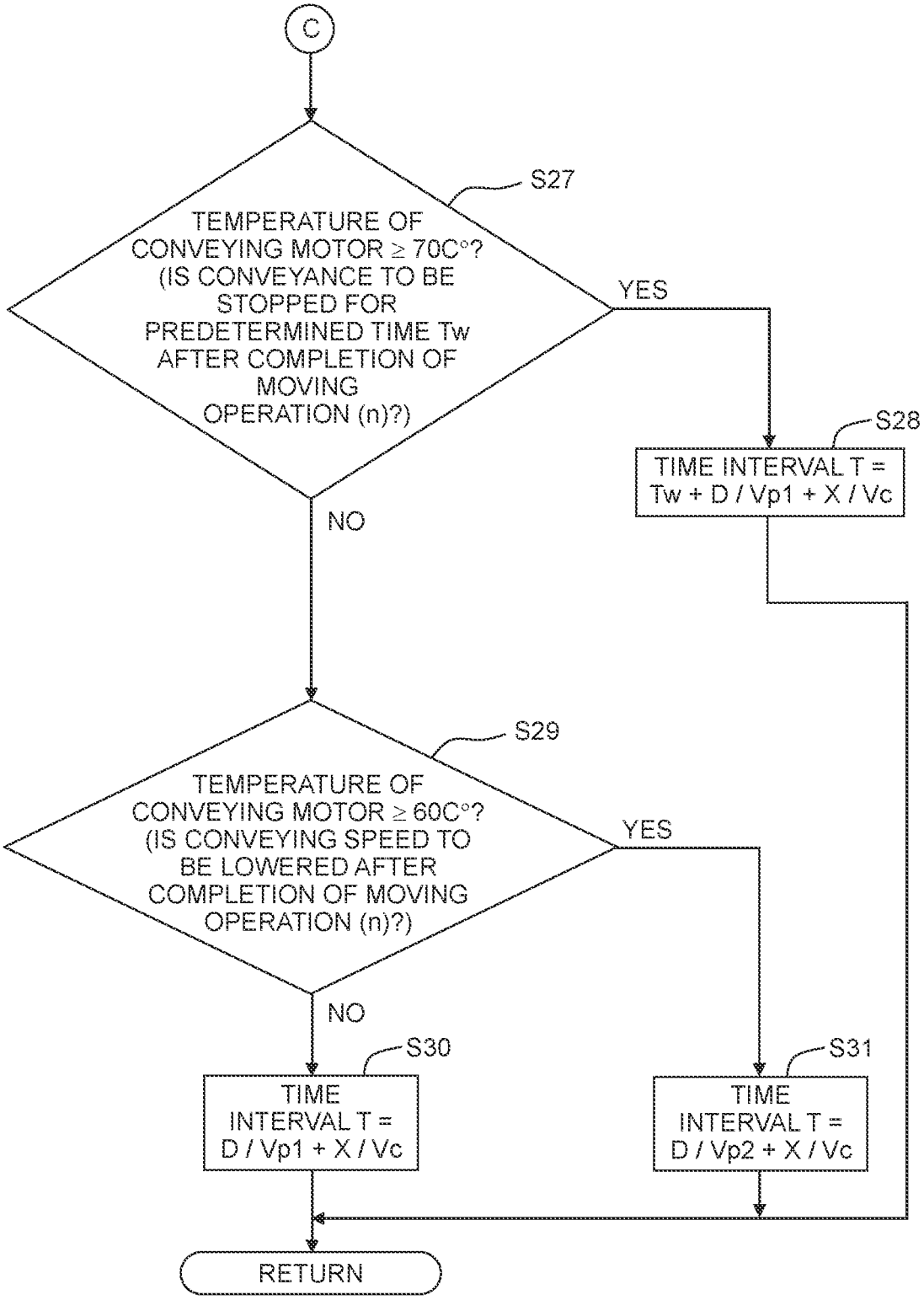

The CPU 91 obtains the time interval T based on the distance D the conveying direction from the area R1 to the area R2 (see steps S21, S28, S30 and S31 in FIGS. 5A and 5B, and FIG. 6). In this case, it is possible to execute the first determining processing (step S14) appropriately, by considering the conveyance of the paper sheet P since the completion of the moving operation (n) and until the start of the moving operation (n+1).

The CPU 91 obtains the time interval T based on whether each of the moving operation (n) and the moving operation (n+1) is which one of the forward moving operation and the reverse moving operation (steps S22 to S26, S28, S30 and S31 of FIGS. 5A and 5B, and FIG. 6). In this case, it is possible to execute the first determining processing (step S14) more appropriately, by considering the moving of the head 10 since the completion of the moving operation (n) and until the start of the moving operation (n+1).

The flushing area 60*r* is positioned at the outside of the conveying area of the paper sheet P by the conveyor 50 (see FIGS. 1 and 6). In this case, it is possible to prevent the paper sheet P from being dirtied and to suppress the consumption of the paper sheet P, as compared with a case that the flushing area is provided in the inside of the conveying area (namely, a case that the flushing is executed on the paper sheet P).

In a case that the CPU 91 determines that the conveying speed is to be lowered from the conveying speed Vp1 to the conveying speed Vp2 after the completion of the moving operation (n) (step S29: YES in FIG. 5B), the CPU 91 obtains the time interval T based on the distance D in the conveying direction from the area R1 to the area R2 (see FIG. 6) and based on the conveying speed Vp2 (see step S31 of FIG. 5B). In this case, it is possible to execute the first determining processing (step S14) more appropriately.

In a case that the CPU 91 determines that the conveyance of the paper sheet P is to be stopped only for the predetermined time Tw after the completion of the moving operation (n) (step S27: YES in FIG. 5B), the CPU 91 obtains the time interval T by adding the predetermined time Tw to the time (D/Vp1) calculated from the distance D the conveying direction from the area. R1 to the area R2 (see FIG. 6) and from the conveying speed Vp1 (see step S28 in FIG. 5B). In this case, it is possible to execute the first determining processing (step S14) more appropriately.

In a case that the CPU 91 determines that the time interval T does not exceed the threshold value (step S14: NO in FIG. 4B), the CPU 91 determines whether or not the jam of the paper sheet P is detected (step S16). Further, in a case that the CPU 91 determines that the jam of the paper sheet P is detected (step S16: YES), the CPU 91 executes the flushing processing (step S15) after the completion of the first recording processing (the recording processing with respect to the area R1: step S12) and before the start of the second recording processing (the recording processing with respect to the area R2: step S5) (the flow is in the following order: step S12 to step S14: NO to step S16: YES to step S15 to step S7, and to step S5). Namely, in a case that the time interval T does not exceed the threshold value but that the jam of the paper sheet P has occurred, the CPU 91 executes the flushing processing. With this, even if the meniscus of the nozzle N is destroyed by the jam of the paper sheet P, it is possible to form the meniscus by the flushing processing, and to execute the second recording processing appropriately.

Second Embodiment

Next, a second embodiment of the present disclosure will be explained, with reference to FIGS. 7 and 8.

Figure 7A:
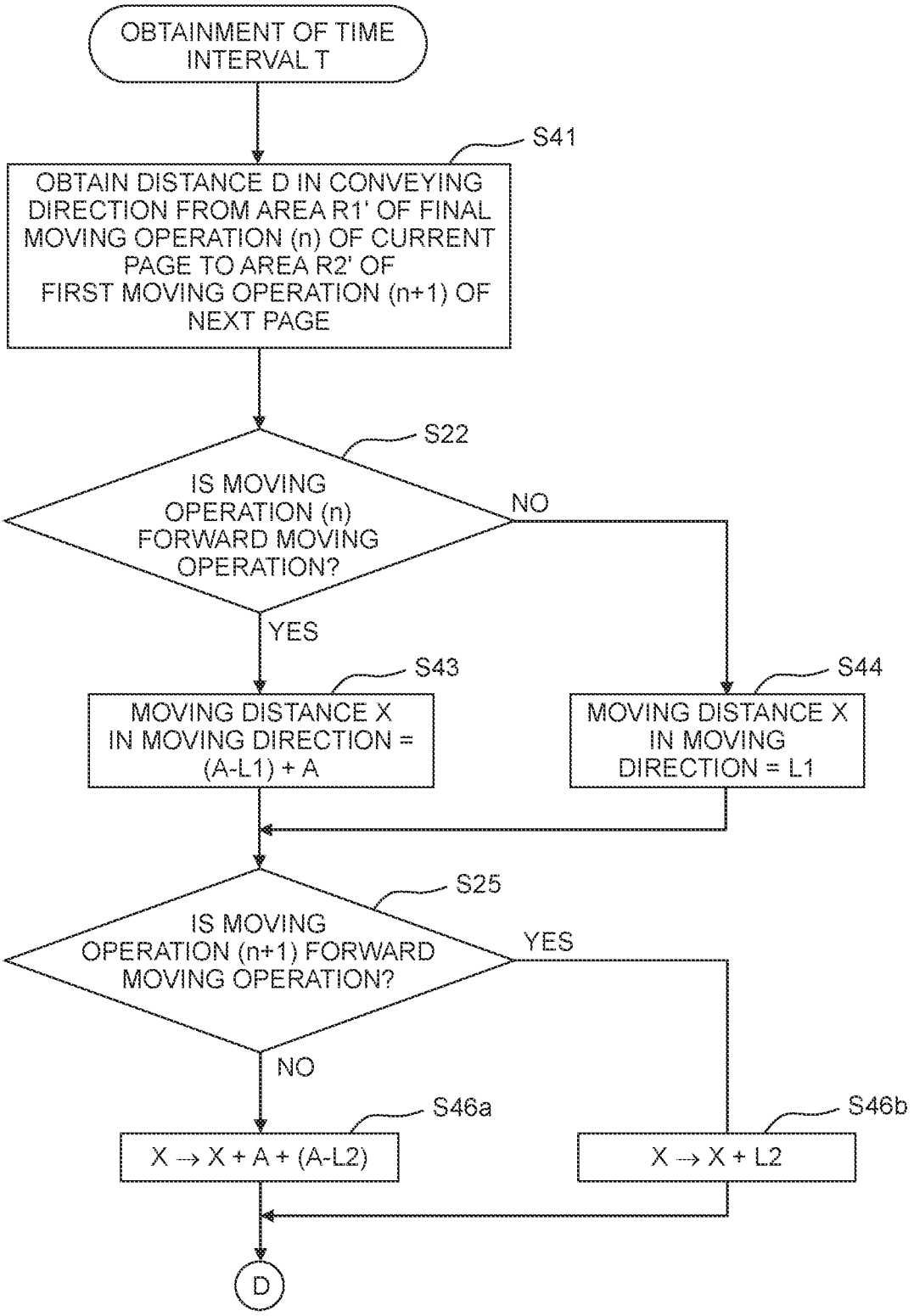
FIGS. 7A and 7B are a flow chart indicating a subroutine of obtaining the time interval T in a second embodiment of the present disclosure.
Figure 7B:
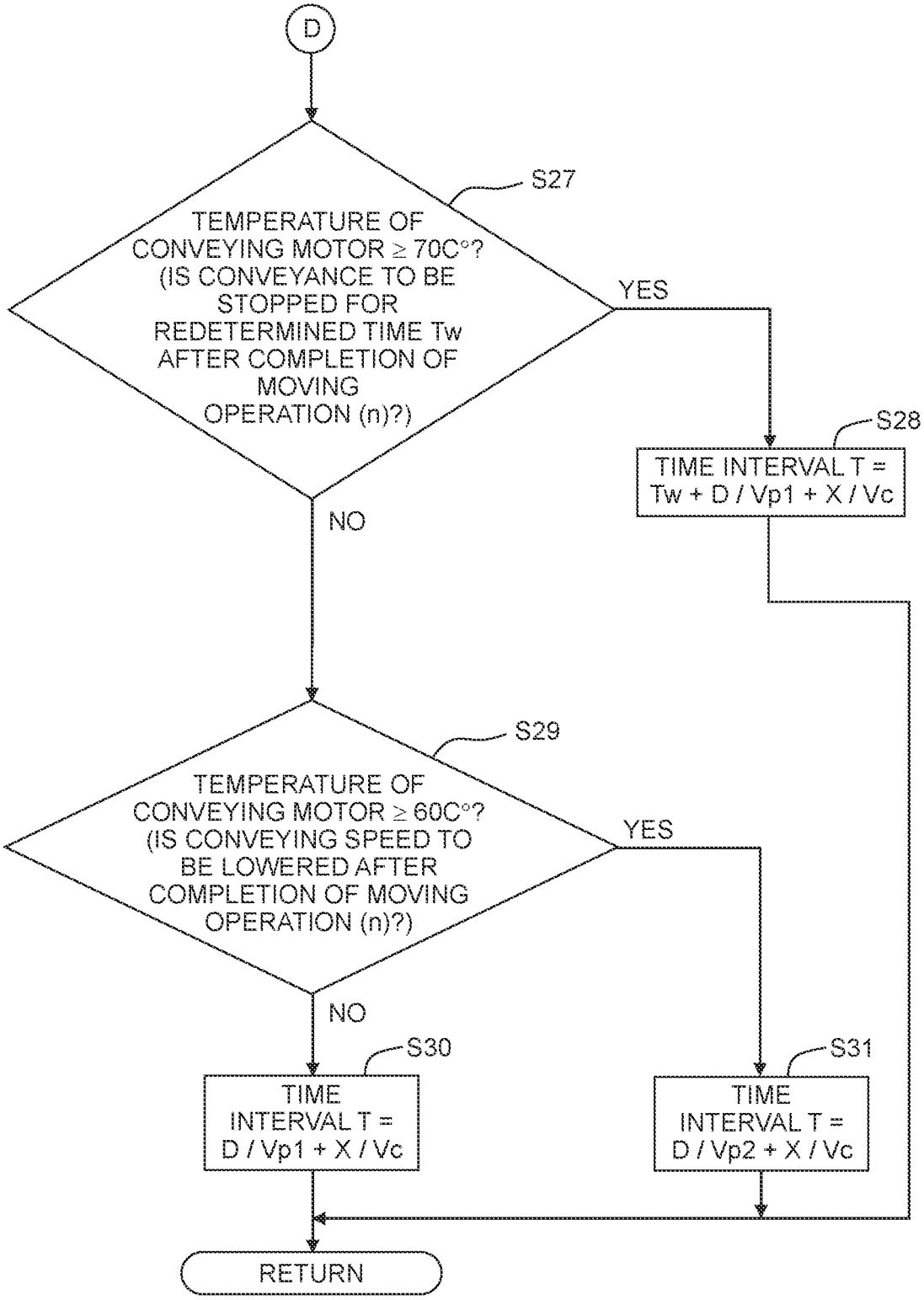

The second embodiment is similar to the first embodiment, except that the content of processing in step S13 of FIG. 4B (subroutine for obtaining the time interval T) is different from that of the first embodiment. In the second embodiment, a subroutine of FIGS. 7A and 7B is applied, as step S13 of FIG. 4B, instead of the subroutine of FIGS. 5A and 5B. In the following, the second embodiment will be explained mainly on the difference from the first embodiment.

As depicted in FIG. 7A, the CPU 91 firstly obtains a distance D in the conveying direction from an area R1' to an area R2' (see FIG. 8) (step S41). In step S41, the CPU 91 obtains positional information in the conveying direction of the area R1' and positional information in the conveying direction of the area R2' based on the image data, and obtains the distance D based on these pieces of the positional information.

In the second embodiment, each of the areas R1' and R2' is not an area, of the paper sheet P, corresponding to the entirety of one time of the moving operation (namely, from the start point to the end point of one time of the moving operation; see the areas R1 and R2 in the first embodiment: FIG. 6); rather, each of the areas R1' and R2' is a part (partial area) in the moving direction of an area, of the paper sheet P, corresponding to one time of the moving operation.

After step S41, in a case that the CPU 91 determines that the moving operation (n) is the "forward moving operation" (step S22: YES), the CPU 91 makes the moving distance X to be "(A−L1)+A" ("A" is a moving distance in the moving direction of the head 10 from the start point to the end point of one time of the moving operation, "L1" is a distance in the moving operation from the area R1' to the flushing area 60*r*: see FIG. 8) (step S43).

After step S41, in a case that the CPU 91 determines that the moving operation (n) is not the "forward moving operation" (the moving operation (n) is the "reverse moving operation"; step S22: NO), the CPU 91 makes the moving distance X to be "L1" (step S44).

In each of steps S43 and S44, the CPU 91 obtains the positional information in the moving direction of the area R1' based on the image data, and obtains the distance L1 based on this positional information. Namely, in each of steps S43 and S44, the CPU 91 obtains the moving distance X based on the position in the moving direction of the area R1'.

The moving distance X is a moving distance in the moving direction of the head 10 after the completion of the moving operation (n) and until the start of the moving operation (n+1). In each of the steps S43 and 44, the CPU 91 sets the moving distance in the moving direction of the head 10 "from the end point of the moving operation (n) to the flushing area 60*r*", as the moving distance X.

After step S43 or step S44, the CPU 91 proceeds the processing to step S25.

In a case that the CPU 91 determines that the moving operation (n+1) is not the "forward moving operation" (that the moving operation (n+1) is the "reverse moving operation") (step S25: NO), the CPU 91 makes the moving distance X to be "X+A+(A−L2)" (step S46*a*).

In a case that the CPU 91 determines that the moving operation (n+1) is the "forward moving operation" (step S25: YES), the CPU 91 makes the moving distance X to be "X+L2" (step S46*b*).

In each of steps S46*a* and S46*b*, the CPU 91 obtains the positional information in the moving direction of the area. R2' based on the image data, and obtains a distance L2 based on this positional information.

In each of steps S46*a* and S46*b*, the CPU 91 adds, to the distance set in step S43 or S44, the moving distance L2 in the moving direction of the head 10 "from the flushing area 60*r* to the start point of the moving operation (n+1)".

After step S46*a* or S46*b*, the CPU 91 executes processings of steps S27 and S31 which are similar to those in the first embodiment (FIG. 5B).

According to the second embodiment, as described above, the CPU 91 is capable of executing the first determining processing (step S14) more appropriately by considering not only the position in the conveying direction of each of the areas R1' and R2' but also the position in the moving direction of each of the areas R1' and R2'.

Modifications

Although the embodiments of the present disclosure have been explained in the foregoing, the present disclosure is not limited to or restricted by the above-described embodiments, and various design changes can be made within the scope of the claims.

The flushing area is not limited to as being positioned at the outside of the conveying area, and may be positioned within the conveying area. For example, in a case that the head is of a line system, it is allowable that the flushing receiving member which is positioned at a standby position at the outside of the conveying area is moved to a location below the head (to the inside of the conveying area), and that the flushing processing is executed. After the execution of the flushing processing, the flushing receiving member may be returned to the standby position. Further, the flushing area is not limited to as being provided on the flushing receiving member, and may be provided on the recording medium (paper sheet P).

In the above-described embodiments (see FIGS. 6 and 8), the first area (area R1, R1') is provided on the paper sheet P1, and the second area (area R2, R2') and the third area (R3) are provided on the paper sheet P2. The present disclosure, however, is not limited to or restricted by this. For example, it is allowable to provide the first to third areas within one piece of the paper sheet P. Further, although the first to third areas are arranged side by side in the conveying direction in the above-described embodiments, the first to third areas may be arranged side by side in the moving direction.

Figure 8:
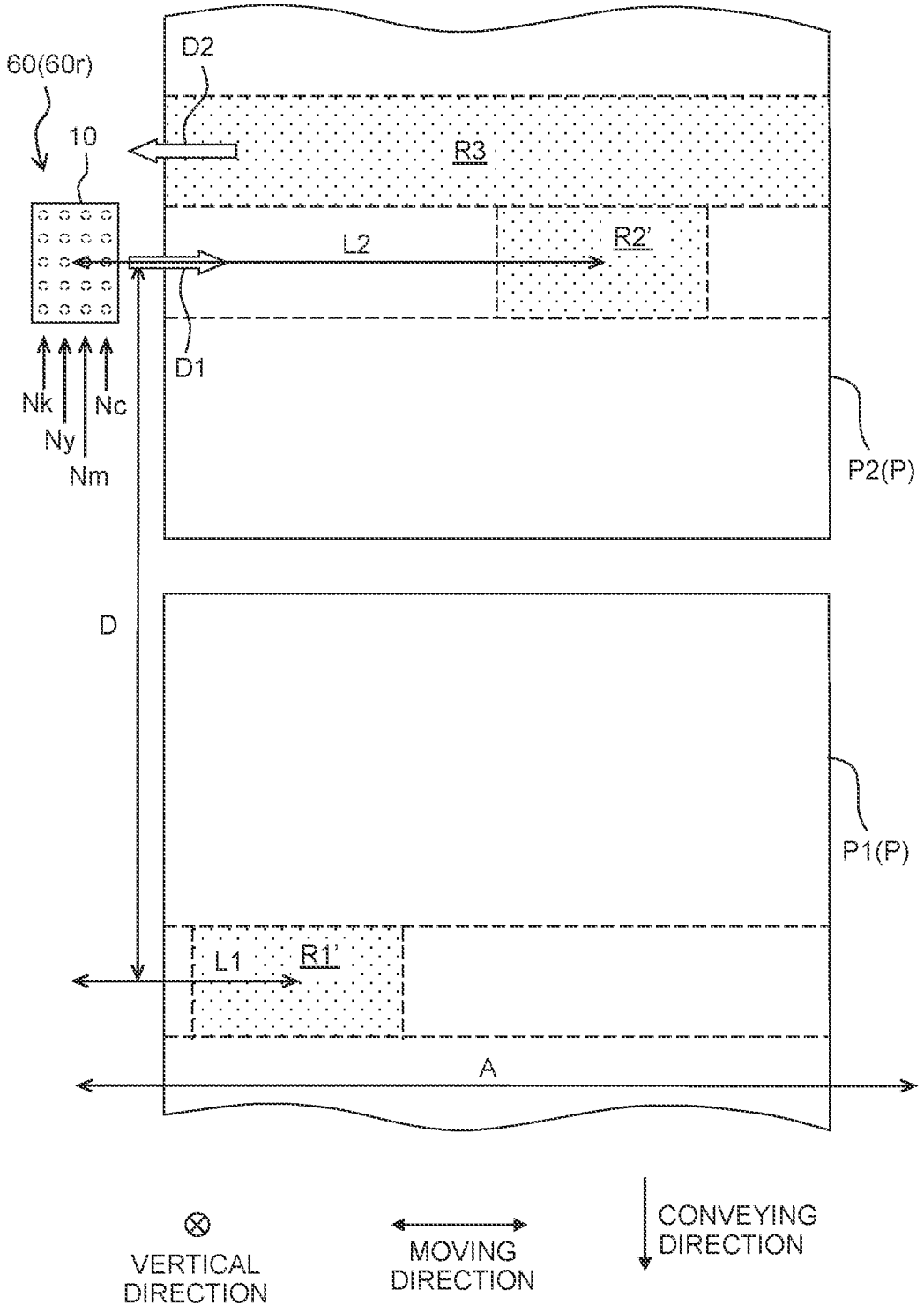
FIG. 8 is a schematic view depicting a situation in which the recording processing is sequentially performed with respect to a plurality of pieces of paper sheet in the second embodiment of the present disclosure.

The distance in the conveying direction from the first area to the second area is the center-to-center distance between the centers of the area R1 (R1') and the area R2 (R2') in the above-described embodiments (see FIGS. 6 and 8). The present disclosure, however, is not limited to this. For example, the distance in the conveying direction from the first area to the second area may be a distance from an upstream end in the conveying direction of the first area to an upstream end in the conveying direction of the second area, or a distance from a downstream end in the conveying direction of the first area to a downstream end in the conveying direction of the second area, or a distance from the downstream end in the conveying direction of the first area to the upstream end in the conveying direction of the second area, or a distance from the upstream end in the conveying direction of the first area to the downstream end in the conveying direction of the second area, etc.

Similarly, in the second embodiment (see FIG. 8), although the distance L1 is the distance from the center in the moving direction of the area R1' to the flushing area 60*r* and the distance L2 is the distance from the center in the moving direction of the area R2' to the flushing area 60*r*, the distance L1 may be a distance from one end or the other end in the moving direction of the area R1' to the flushing area 60*r*, and the distance L2 may be a distance from one end or the other end in the moving direction of the area R2' to the flushing area 60*r*.

Regarding the detection of the jam in the above-described embodiment, in a case that the jam does not occur, the light emitted from the light-emitting element is not received by the light-receiving element, whereas in a case that the jam occurs, the light emitted from the light-emitting element is received by the light-receiving element. It is allowable, however, to provide a reverse configuration to the above-described configuration. For example, it is allowable that in the case that the jam does not occur, the jam detecting member is located at a position at which the jam detecting member does not shield or block the light emitted from the light-emitting element, thereby allowing the light emitted from the light-emitting element to be received by the light-receiving element, whereas in the case that the jam occurs, the jam detecting member is moved (from the above-described position) to a position at which the jam detecting member makes contact with the paper sheet and at which the jam detecting member shields or blocks the light emitted from the light-emitting element, thereby preventing the light emitted from the light-emitting element from being received by the light-receiving element.

In the foregoing embodiment, the determination as to whether the conveyance of the recording medium by the conveyor is to be "stopped for the predetermined time" or "the speed of the conveyance is to be lowered from the first speed to the second speed which is lower than the first speed" after the completion of the first recording processing is performed based on the temperature of the conveying motor (steps S27, S29 of FIG. 5B and FIG. 7B). The present disclosure, however, is not limited to this. For example, it is allowable to perform the above-described determination based on the temperature of the carriage motor, or based on the environmental temperature of the head.

Although the head in the above-described embodiment is of the serial system, the head may be of the line system.

The liquid ejected from the nozzles is not limited to the ink, and may be a liquid which is different from the ink (e.g., a treatment liquid which agglutinates or precipitates a component(s) of ink, etc.).

The recording medium is not limited to the paper sheet (paper), and may be a cloth, a resin member, etc.

The present disclosure is also applicable to facsimiles, copy machines, multifunction peripherals, etc. without limited to printers. The present disclosure is also applicable to a liquid discharge apparatus used for any other application than the image recording (e.g., a liquid discharge apparatus which forms an electroconductive pattern by ejecting an electroconductive liquid on a substrate).

The program according to the present disclosure is distributable by being recorded on a removable-type recording medium such as a flexible disk, etc., and on a fixed-type recording medium such as a hard disk, etc., and is also distributable via a telecommunication line.

What is claimed is:

1. A liquid ejecting apparatus comprising:

a head having a plurality of nozzles;

a moving mechanism configured to move the head in a moving direction;

a conveyor configured to convey a recording medium; and a controller, wherein the controller is configured to execute:

a recording processing of causing the conveyor to convey the recording medium and causing the head to eject liquid from the nozzles with respect to the recording medium based on image data; and a flushing processing of discharging the liquid from the nozzles with respect to a flushing area, based on flushing data different from the image data, wherein the controller is further configured to execute a first determining processing of determining, based on the image data, whether a time interval after completion of a first recording processing and until start of a second recording processing exceeds a threshold value, the first recording processing being the recording processing with respect to a first area of the recording medium, the second recording processing being the recording processing with respect to a second area of the recording medium and being executed after the first recording processing, wherein in a case that the controller determines that the time interval exceeds the threshold value in the first determining processing, the controller is configured to execute the flushing processing after the completion of the first recording processing and before the start of the second recording processing, wherein in the recording processing, the controller is configured to execute a conveying operation of causing the conveyor to convey the recording medium by a predetermined amount in a conveying direction orthogonal to the moving direction, and a moving operation of ejecting the liquid from the nozzles while causing the moving mechanism to move the head in the moving direction, wherein each of the first area and the second area is an area, of the recording medium, which overlaps with the head while the controller causes the head and the moving mechanism to execute the moving operation, and wherein the controller is configured to cause the head and the moving mechanism to execute the moving operation with respect to the second area after causing the head and the moving mechanism to execute the moving operation with respect to the first area.

2. The liquid ejecting apparatus according to claim 1, further comprising a memory configured to store the image data, wherein the moving operation includes a first moving operation and a second moving operation, the first moving operation being an operation of ejecting the liquid from the nozzles with respect to the first area while causing the moving mechanism to move the head in the moving direction, the second moving operation being an operation of ejecting the liquid from the nozzles with respect to the second area while causing the moving mechanism to move the head in the moving direction, wherein the image data includes first image data for ejecting the liquid from the nozzles in the first moving operation and second image data for ejecting the liquid from the nozzles in the second moving operation, and wherein the controller is configured to:

store the first image data and the second image data in the memory before the first moving operation and the second moving operation;

start the first moving operation in a state that the first image data and the second image data are stored in the memory;

delete the first image data from the memory after completion of the first moving operation; and delete the second image data from the memory after completion of the second moving operation.

3. The liquid ejecting apparatus according to claim 2, wherein the moving operation further includes a third moving operation of ejecting the liquid from the nozzles with respect to a third area of the recording medium while causing the moving mechanism to move the head in the moving direction, wherein the third area is an area, of the recording medium, which overlaps with the head while the controller causes the head and the moving mechanism to execute the moving operation, wherein the controller is configured to cause the head and the moving mechanism to execute the moving operation with respect to the third area after causing the head and the moving mechanism to execute the moving operation with respect to the second area, wherein the image data further includes third image data for ejecting the liquid from the nozzles in the third moving operation, and wherein the controller is configured to:

store the third image data in the memory, after deleting the first image data from the memory; and start the second moving operation in a state that the second image data and the third image data are stored in the memory.

4. The liquid ejecting apparatus according to claim 1, wherein in the first determining processing, the controller is configured to obtain the time interval based on a distance in the conveying direction from the first area to the second area.

5. The liquid ejecting apparatus according to claim 4, wherein each of the first area and the second area is a partial area in the moving direction of the area, of the recording medium, which overlaps with the head while the controller causes the head and the moving mechanism to execute the moving operation, and wherein the controller is configured to obtain, in the first determining processing, the time interval based on a position in the moving direction of the first area.

6. The liquid ejecting apparatus according to claim 1, wherein the moving operation includes a forward moving operation and a reverse moving operation, the forward moving operation being an operation of ejecting the liquid from the nozzles while causing the moving mechanism to move the head from one side toward the other side of the moving direction, the reverse moving operation being an operation of ejecting the liquid from the nozzles while causing the moving mechanism to move the head from the other side toward the one side of the moving direction, and wherein in the first determining processing, the controller is configured to obtain the time interval based on whether the forward moving operation is executed or the reverse moving operation is executed in each of the first recording processing and the second recording processing.

7. The liquid ejecting apparatus according to claim 1, wherein the flushing area is positioned outside of a conveyance area of the recording medium by the conveyor.

8. The liquid ejecting apparatus according to claim 1, wherein the controller is configured to further execute a second determining processing of determining whether a conveying speed of the recording medium by the conveyor is to be lowered from a first speed to a second speed, which is lower than the first speed, after the completion of the first recording processing, and wherein in a case that the controller determines that the conveying speed is to be lowered to the second speed in the second determining processing, the controller is configured to obtain the time interval in the first determining processing based on a distance in the conveying direction from the first area to the second area and based on the second speed.

9. The liquid ejecting apparatus according to claim 1, wherein the controller is configured to further execute a third determining processing of determining whether conveyance of the recording medium by the conveyor is to be stopped for a predetermined time after the completion of the first recording processing, and wherein in a case that the controller determines that the conveyance is to be stopped for the predetermined time in the third determining processing, the controller is configured to obtain the time interval in the first determining processing by adding the predetermined time to a time calculated from a distance in the conveying direction from the first area to the second area and from a conveying speed of the recording medium by the conveyor after the completion of the first recording processing and until the start of the second recording processing.

10. A liquid ejecting apparatus comprising:

a head having a plurality of nozzles;

a conveyor configured to convey a recording medium; and a controller, wherein the controller is configured to execute:

a recording processing of causing the conveyor to convey the recording medium and causing the head to eject liquid from the nozzles with respect to the recording medium based on image data; and a flushing processing of discharging the liquid from the nozzles with respect to a flushing area, based on flushing data different from the image data, wherein the controller is further configured to execute a first determining processing of determining, based on the image data, whether a time interval after completion of a first recording processing and until start of a second recording processing exceeds a threshold value, the first recording processing being the recording processing with respect to a first area of the recording medium, the second recording processing being the recording processing with respect to a second area of the recording medium and being executed after the first recording processing, wherein in a case that the controller determines that the time interval exceeds the threshold value in the first determining processing, the controller is configured to execute the flushing processing after the completion of the first recording processing and before the start of the second recording processing, and wherein in a case that the controller determines that the time interval does not exceed the threshold value in the first determining processing and that a jam of the recording medium is detected, the controller is configured to execute the flushing processing after the completion of the first recording processing and before the start of the second recording processing.

* * * * *